US006418884B1

(12) United States Patent
Rucker

(10) Patent No.: US 6,418,884 B1
(45) Date of Patent: Jul. 16, 2002

(54) FUEL-FIRED HEATING APPLIANCE HAVING FLAME ARRESTOR PLATE WITH ASSOCIATED SCALE DEFLECTOR SHIELD

(75) Inventor: John C. Rucker, Montgomery, AL (US)

(73) Assignee: Rheem Manufacturing Company, New York, NY (US)

( * ) Notice: Subject to any disclaimer, the term of this patent is extended or adjusted under 35 U.S.C. 154(b) by 0 days.

(21) Appl. No.: 09/977,796

(22) Filed: Oct. 15, 2001

(51) Int. Cl.[7] ..... F22B 5/00

(52) U.S. Cl. ..... 122/504; 122/13.01; 122/17.2; 122/18.31

(58) Field of Search ..... 122/13.01, 17.1, 122/17.2, 18.3, 18.31, 504

(56) References Cited

U.S. PATENT DOCUMENTS

| | | | | |
|---|---|---|---|---|
| 1,971,139 A | | 8/1934 | Harris | |
| 3,016,885 A | | 1/1962 | Vandenburgh et al. | |
| 3,029,795 A | | 4/1962 | Binger et al. | |
| 4,790,289 A | | 12/1988 | Barrett | |
| 4,940,042 A | * | 7/1990 | Moore et al. | 122/18.2 |
| 4,944,253 A | | 7/1990 | Bellofatto | |
| 5,826,569 A | * | 10/1998 | Voorhis | 122/18.31 |
| 5,875,739 A | | 3/1999 | Joyce | |
| 5,941,200 A | | 8/1999 | Boros et al. | |
| 6,003,477 A | * | 12/1999 | Valcic | 122/14.21 |
| 6,109,216 A | * | 8/2000 | Reynolds et al. | 122/13.01 |

* cited by examiner

*Primary Examiner*—Jiping Lu
(74) *Attorney, Agent, or Firm*—Konneker & Smith, P.C.

(57) ABSTRACT

A fuel-fired heating appliance, representatively a gas-fired water heater, has a combustion chamber with a flame arrestor plate forming a bottom wall thereof. The arrestor plate has a spaced series of flame quenching perforations therein through which combustion air upwardly flows into the combustion chamber during firing of the water heater. A shield structure within the combustion chamber overlies the arrestor plate perforations in an upwardly spaced relationship therewith and blocks operating scale on the bottom side of the top combustion chamber wall, and/or a flue extending upwardly from the top combustion chamber wall, from falling on and blocking the combustion air transfer perforations in the flame arrestor plate.

15 Claims, 3 Drawing Sheets

FUEL-FIRED HEATING APPLIANCE HAVING FLAME ARRESTOR PLATE WITH ASSOCIATED SCALE DEFLECTOR SHIELD

BACKGROUND OF THE INVENTION

The present invention generally relates to fuel-fired heating appliances and, in a preferred embodiment thereof, more particularly provides a gas-fired water heater having a combustion chamber bottom wall portion defined by a perforated flame arrestor plate with which an overlying scale deflector shield structure is operatively associated.

Gas-fired residential and commercial water heaters are generally is formed to include a vertical cylindrical water storage tank with a gas burner structure disposed in a combustion chamber below the tank. The burner is supplied with a fuel gas through a gas supply line, and combustion air through one or more air inlet passages providing communication between ambient air and the interior of the combustion chamber.

Water heaters of this general type are extremely safe in operation. However, when gasoline or other flammable liquids are stored or used improperly in proximity to the water heater, there may exist a possibility of flammable vapors becoming entrained in the air intake of the water heater. It is theorized that such vapors might cause secondary combustion to occur within the confines of the water heater combustion chamber. It is accordingly possible for the resulting flame to propagate out of the combustion chamber into the ambient environment around the water heater as a result of following the intake path of the flammable vapor.

In view of this, various modern gas-fired water heater designs, as well as the designs of other types of fuel-fired heating appliances, focus upon the inhibition and/or control of the entrance of flammable vapors into the combustion chamber of the appliance. One previously proposed method of carrying out this design goal is to provide the combustion chamber with a bottom wall portion defined by a flame arrestor plate structure in which a spaced series of flame quenching combustion air inlet openings are formed.

During firing of the water heater, combustion air is drawn upwardly through these openings into the combustion chamber, mixed with fuel being discharged from the burner, and combusted to create heat transferred to water stored in the tank portion of the water heater. The combustion air inlet openings are configured in a manner such that they readily permit combustion air, and extraneous flammable vapors entrained therein, to pass therethrough into the combustion chamber, while at the same time substantially precluding downward passage of combustion chamber flames through the openings.

In order to perform their flame quenching function, these openings are typically quite small, and may be susceptible to clogging by particulate matter. Such clogging undesirably reduces the overall combustion efficiency of the water heater. Among the sources of particulate matter, which can restrict combustion air inlets, are the eventual creation of scale deposits normally generated as the gas-side surfaces of the water tank degrade with oxidation of the metal surfaces that are exposed to combustion gases. Over time, some of these scale deposits tend to flake off the gas-side surfaces of the bottom head and flue walls, thereby falling onto the top side of the arrestor plate and eventually clogging some of the arrestor plate openings.

It would be desirable to provide an arrestor plate structure for the combustion chamber of a fuel-fired heating appliance, such as a gas-fired water heater, which eliminates or at least substantially reduces this potential air inlet clogging problem. It is to this goal that the present invention is primarily directed.

SUMMARY OF THE INVENTION

In carrying out principles of the present invention, in accordance with a preferred embodiment thereof, specially designed fuel-fired heating apparatus is provided which is representatively in the form of a gas-fired water heater, but could alternatively be fuel-fired heating apparatus of another type such as, for example, a fuel-fired boiler or furnace.

From a broad perspective, the fuel-fired heating apparatus comprises a combustion chamber communicatable with a fluid to be heated and having vertically spaced apart, facing top and bottom wall structures, a portion of the bottom wall structure having combustion air inlet openings therein which are preferably configured and operative as flame quenching openings. Representatively, such bottom wall structure is defined by a perforated flame arrestor plate having a plate-like body in which the flame quenching combustion air inlet openings are suitably formed. A fuel burner is disposed within the combustion chamber and is supplied with fuel via a fuel supply pipe connected thereto and extending through the combustion chamber.

The fuel-fired heating apparatus further comprises a shield member disposed within the combustion chamber, overlying the combustion air inlet openings in an upwardly spaced relationship therewith, and positioned to intercept particulate matter, such as scale, falling from the top combustion chamber wall structure to prevent the fallen particulate matter from landing in and clogging the combustion air inlet openings. Representatively, the shield member has an upwardly domed configuration and has a peripheral portion which is suitable secured to a peripheral portion of the arrestor plate body.

In one illustrated embodiment of the fuel-fired heating apparatus, the mutually spaced series of combustion air inlet openings are distributed over substantially all of the arrestor plate body, and the shield member extends across substantially the entire top side of the arrestor plate, in an upwardly spaced relationship therewith, and has a top side cutout area receiving the fuel burner and a portion of the fuel supply pipe. The shield member defines a combustion air receiving plenum, disposed above the flame arrestor plate within the combustion chamber, which is operative to receive combustion air upwardly exiting the combustion air inlet openings, the combustion air receiving plenum communicating with the balance of the combustion chamber through such cutout area.

In another illustrated embodiment of the fuel-fired heating apparatus, the mutually spaced series of air inlet openings are disposed in only a part of the arrestor plate body, with the balance of the body being substantially imperforate. The shield member extends across the top side of only the perforated part of the arrestor plate body, in an upwardly spaced relationship therewith, and defines a combustion air receiving plenum, disposed within the combustion chamber above the combustion air inlet openings, which is operative to receive combustion air upwardly exiting the combustion air inlet openings, the combustion air receiving plenum having an outlet portion through which it communicates with the balance of the combustion chamber. Representatively, such outlet portion is defined by an outlet opening which faces in a direction parallel to the top side of the arrestor plate body.

In an illustrated fuel-fired water heater embodiment of the invention, a flue extends upwardly from the top wall structure and through water stored in a tank portion of the water heater. The shield member is operative to prevent particulate matter, such as scale, from falling from the flue and/or the top combustion chamber wall and landing in and clogging the air inlet openings.

DETAILED DESCRIPTION

Figure 1:
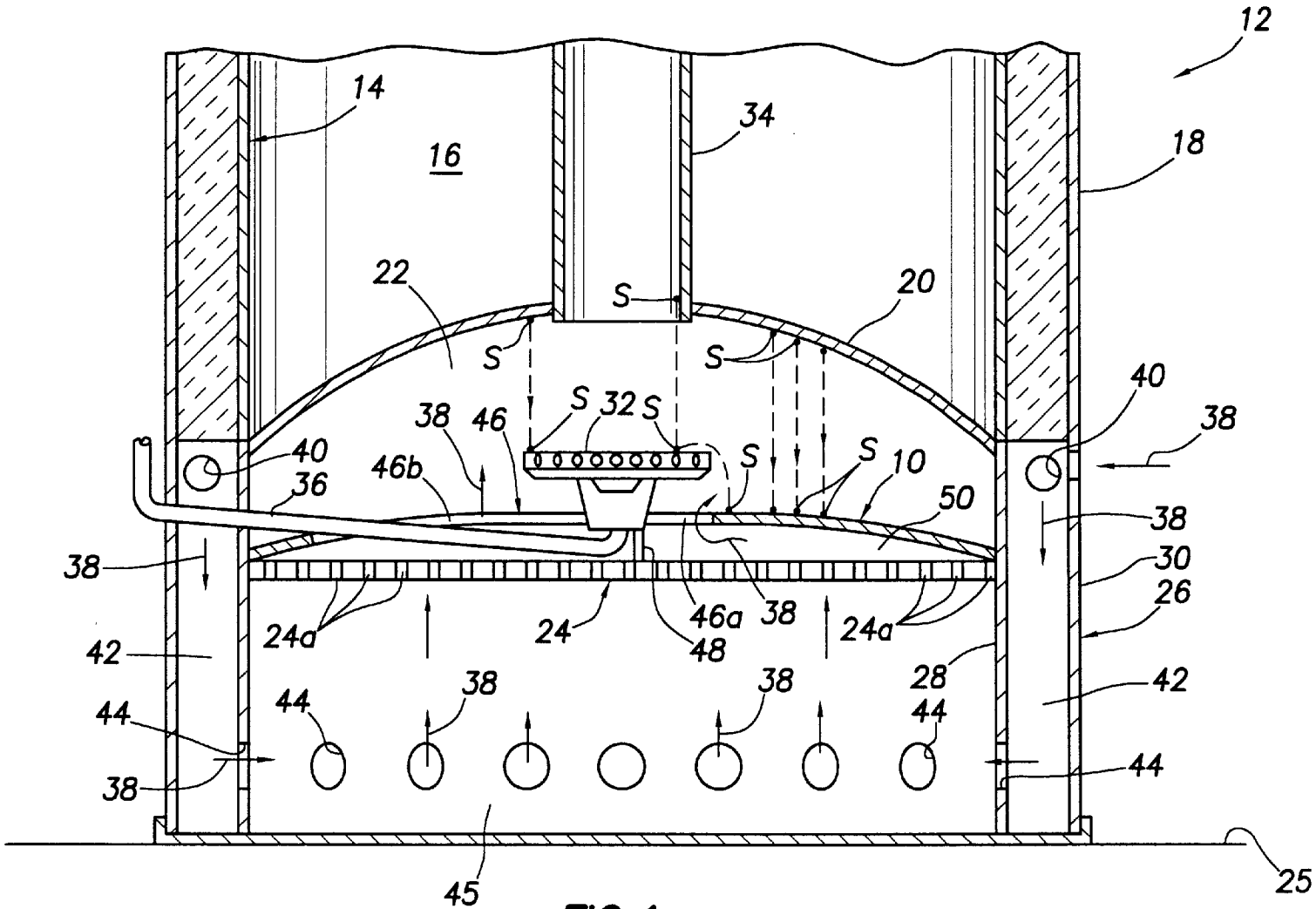
FIG. 1 is a simplified, somewhat schematic cross-sectional view through a portion of a representative gas-fired water heater having is incorporated therein, as a bottom wall portion of its combustion chamber, a perforated combustion air inlet flame arrestor plate with which an overlying scale deflector shield structure is operatively associated.
Figure 2:
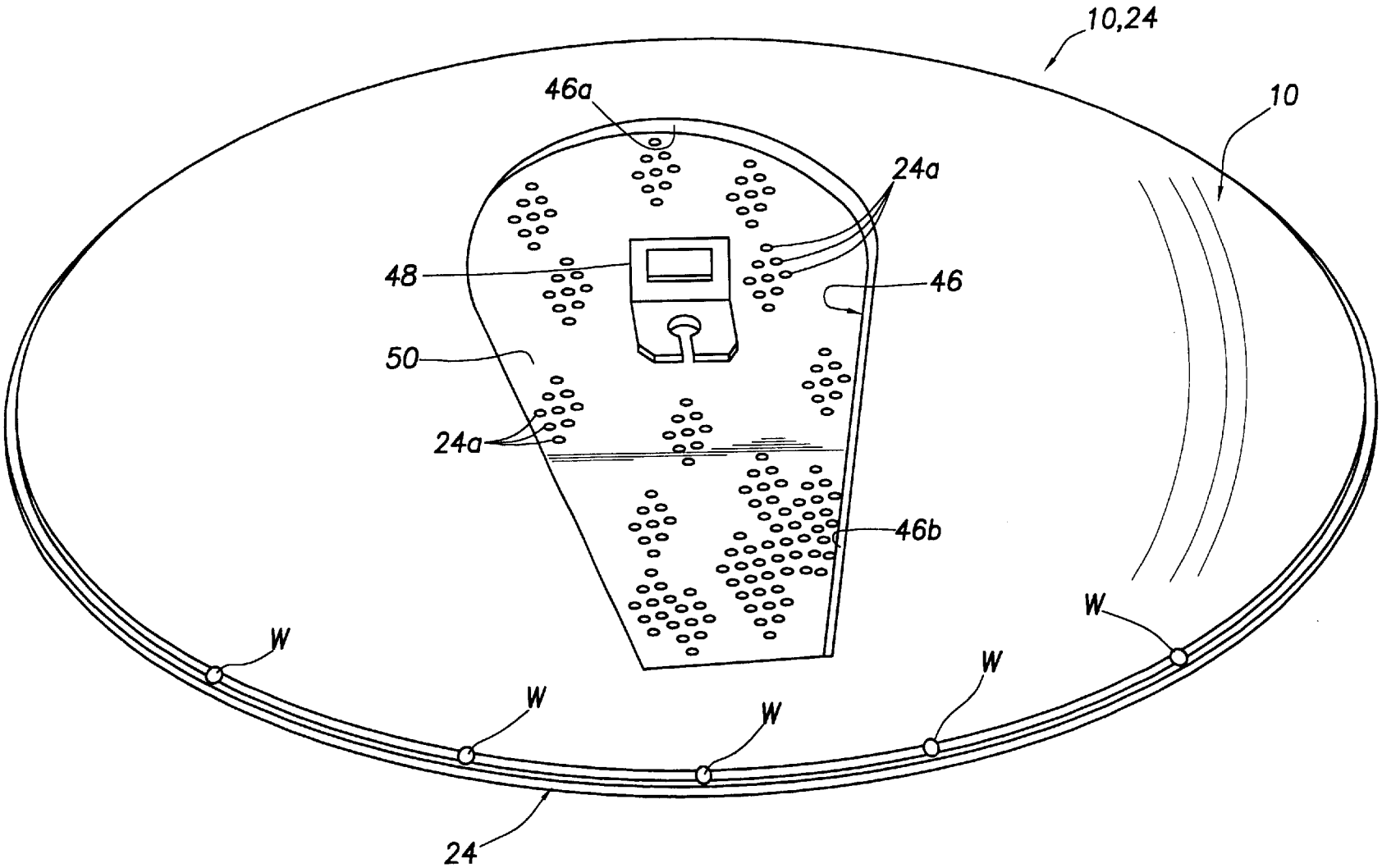
FIG. 2 is an enlarged scale perspective view of the arrestor plate/deflector shield assembly removed from the water heater.

As illustrated in somewhat simplified form in FIGS. 1 and 2, this invention provides a scale deflector shield 10 which is installable in a gas-fired water heater 12 or other type of fuel-fired heating appliance such as a boiler or furnace. Representatively, water heater 12 has a vertically oriented cylindrical metal tank 14, in which water 16 to be heated is stored, the tank 14 being surrounded by an insulated jacket structure 18 and having an upwardly domed bottom head portion 20. The bottom head portion 20 defines the upper side of a combustion chamber 22 bounded on its lower side by a circular, perforated plate 24. Illustratively, water heater 10 is restable on a suitable horizontal support surface such as the floor 25 shown in FIG. 1.

Extending downwardly from the bottom end of the tank 14 is an annular skirt structure 26 having inner and outer vertical side walls 28 and 30. A gas burner 32 is centrally positioned within a lower portion Of the combustion chamber 22, just above a central top side portion of the bottom plate 24, and underlies the open lower end of a vent pipe or flue 34 extending upwardly through the interior of the tank 14 and the water 16 therein. Gas is supplied to the burner 32 via a gas supply pipe 36 extending inwardly through the skirt structure 26 and into the combustion chamber 22.

During firing of the water heater 12, combustion air 38 is drawn inwardly through upper holes 40 in the outer skirt side wall 30, downwardly through the annular space 42 between the inner and outer skirt walls 28 and 30, and then passes through lower holes 44 in the inner skirt wall 28 and into a cylindrical chamber 45 disposed directly beneath the perforated bottom combustion chamber plate or wall 24. The combustion air 38 then flows upwardly through the perforations 24*a* in the overlying plate 24 and enters the combustion chamber 22 for mixture and combustion with gas being discharged by the burner 32. The resulting hot products of combustion then flow upwardly through the vent pipe or flue 34, with heat from these combustion products being transferred to the water 16 through the side wall of the vent pipe 34.

Preferably, the perforated plate 24 is operative as a flame arrestor plate, with the plate perforations 24*a* being configured as flame quenching openings that function to permit upward flow therethrough of the combustion air 38, and extraneous flammable vapors which may be entrained in the combustion air, but substantially preclude the downward passage of flames from the combustion chamber 22 through the perforations 24*a*. An example of such flame quenching openings in a flame arrestor plate portion of a gas-fired water heater may be found in U.S. Pat. No. 5,941,200 to Boros et al which is hereby incorporated herein by reference.

Over time, scale S forms on the bottom side of the bottom head portion 20, and/or the inner side of the flue 34, and falls to the bottom of the combustion chamber 22. Due to the fact that in the water heater 12 the combustion air 38 flows upwardly through perforations 24*a* in the bottom arrestor plate wall 24 of the combustion chamber 22, this falling scale could tend to block the perforations and adversely affect the combustion process.

According to a key aspect of this invention, the scale deflector shield 10 is uniquely utilized to alleviate this potential problem. The shield 10 has a generally inverted saucer shape and its periphery is suitably secured to the periphery of the top side of the perforated plate 24 within the combustion chamber 22, for example by spot welds W, to form the shield/arrestor plate assembly 10, 24 shown in FIG. 2. The upwardly domed shield 10 has a cutout area 46 formed therein, the cutout area having a generally circular central portion 46*a* from which an elongated portion 46*b* outwardly extends in a generally radial direction. As best illustrated in FIG. 1, the gas pipe 36 extends generally horizontally through the thinner shield opening portion 46*b*, and the generally circular body of the burner 32 upwardly overlies the similarly shaped and sized central shield opening portion 46*a*. The burner 32 is mounted on a suitable support bracket structure 48 (see FIGS. 1 and 2) centrally secured to the top side of the perforated flame arrestor plate 24.

Combustion air 38 upwardly exiting the perforations 24*a* in the flame arrestor plate 24 enters a plenum 50 defined between the upwardly domed shield 10 and the plate 24, travels through the plenum 50, and then upwardly exits the plenum 50 via the shield cutout area 46. Scale S (see FIG. 1) falling from the bottom side of the bottom head portion 20 of is the tank 14, and/or the inner side of the flue 34, harmlessly falls on (1) the top side of the burner 32 and (2) the top side of the shield 10—as opposed to simply falling on the top side of the plate 24, blocking its perforations 24*a* and thereby impeding combustion air entry into the combustion chamber 22. Accordingly, the small arrestor plate perforations 24*a* are desirably prevented by the shield 10 from becoming clogged by falling scale deposits within the combustion chamber 22.

While the cutout area 46 in the shield 10 is configured to receive he burner 32 and the gas supply pipe 36, it will be readily appreciated by those of ordinary in this particular art that the cutout area 46 could be provided with various alternate configurations to receive differently shaped burners, and fuel supply piping connected to the burner in different manners. Additionally, while the illustrated arrestor plate 24 is provided with flame quenching combustion air transfer perforations 24*a* over essentially all of its side surfaces, it will be appreciated that differently configured flame arrestor plates could be utilized in place of the plate 24 if desired.

Figure 3:
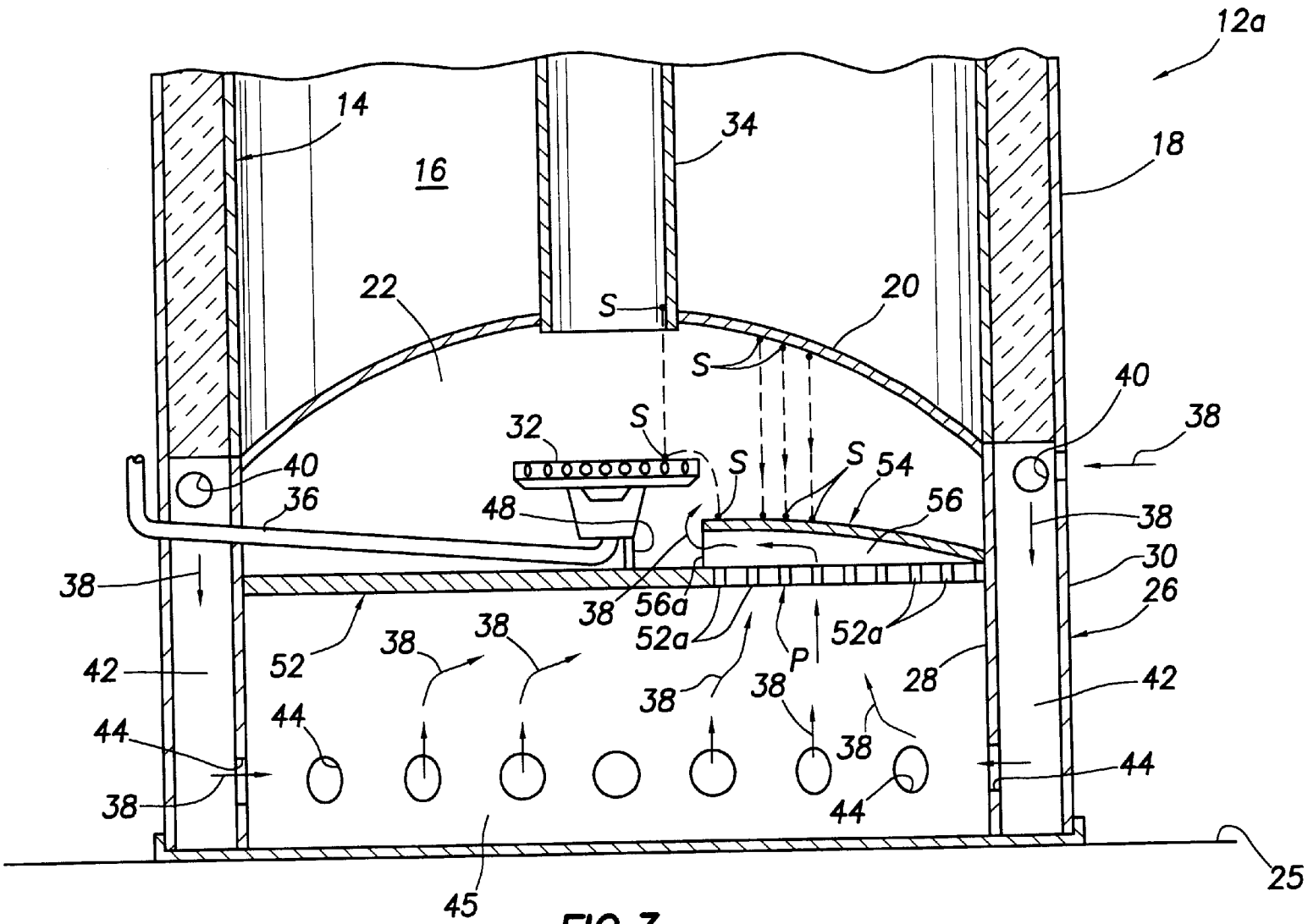
FIG. 3 is a simplified, somewhat schematic cross-sectional view through an alternate embodiment of the gas-fired water heater shown in FIG. 1.

For example, an alternate embodiment 12*a* of the previously described hot water heater 12 is cross-sectionally illustrated in simplified, somewhat schematic form in FIG. 3. Representatively, the water heater 12*a* is identical to the previously described water heater 12 with the exception that it is provided with a differently configured perforated, flame quenching arrestor plate 52, and a differently configured scale deflector shield 54.

Instead of being perforated along substantially its entire horizontal extent (as in the case of the previously described arrestor plate 24), the arrestor plate 52 is perforated only along a portion P thereof which is representatively positioned to the right of the burner 32 as viewed in FIG. 3. The perforated portion P is defined by a spaced series of flame quenching combustion air transfer perforations 52*a*. The remainder of the plate 52 is essentially imperforate.

The modified scale deflector shield 54, unlike the previously described shield 10, does not extend above the entire plate 52 and have a cutout area for the burner 32 and the gas supply pipe 36. Instead, the shield 54 extends across only the perforated area P in an upwardly spaced relationship therewith within the combustion chamber 22. Shield 54 defines a plenum 56 between the shield 54 and the plate 52 above the perforated plate area P, the plenum 56 having a horizontally facing open outlet side 56*a*.

Still referring to FIG. 3, during firing of the water heater 12*a* combustion air 38 upwardly exiting the perforations 52*a* in the flame arrestor plate 52 enters the plenum 56, travels through the plenum 56, and then horizontally exits the plenum 56 via its side opening area 56*a*. Scale S falling from the bottom side of the bottom head portion 20 of the tank 14 above the perforated plate area P, and/or the inner side of the flue 34, harmlessly falls on the top side of the shield 54 instead of falling on the top side of the perforated plate area P and blocking its perforations 52*a* and thereby impeding combustion air entry into the combustion chamber 22. Accordingly, the small arrestor plate perforations 52*a* are desirably prevented by the shield 54 from becoming clogged by falling scale deposits within the combustion chamber 22.

AS previously mentioned herein, principles of the present invention are not limited to gas-fired water heaters but may also be utilized to advantage in a variety of other types of fuel-fired heating appliances including, but not limited to, fuel-fired furnaces and boilers. Additionally, while the illustrated water heaters 12 and 12*a* have cylindrical configurations, it will readily be appreciated by those of ordinary skill in this particular art that they could have different configurations, such as rectangular, is desired. Further while the illustrated flame arrestor plates 24, 54 have been representatively illustrated as defining essentially the entire bottom walls of their associated combustion chambers, they could alternatively be configured to define only portions of such bottom walls.

The foregoing detailed description is to be clearly understood as being given by way of illustration and example only, the spirit and scope of the present invention being limited solely by the appended claims.

What is claimed is:

1. Fuel-fired heating apparatus comprising:

a combustion chamber communicatable with a fluid to be heated and having vertically spaced apart, facing top and bottom wall structures, a portion of said bottom wall structure having combustion air inlet openings therein;

a fuel burner disposed within said combustion chamber;

a shield member disposed within said combustion chamber, overlying said combustion air inlet openings in an upwardly spaced relationship therewith, and positioned to intercept particulate matter falling from said top wall structure and prevent the fallen particulate matter from landing in and clogging said combustion air inlet openings, said bottom wall structure being a flame arrestor plate having a body portion, said mutually spaced series of combustion air inlet openings being configured and operative as flame quenching openings; and a fuel supply pipe extending through said combustion chamber and operatively coupled to said fuel burner, said shield member extending across substantially the entire top side of said flame arrestor plate and having a cutout area receiving portions of said fuel burner and said fuel supply pipe, and said shield member defining a combustion air receiving plenum, disposed above said flame arrestor plate within said combustion chamber, which is operative to receive combustion air upwardly exiting said combustion air inlet openings, said combustion air receiving plenum communicating with the balance of said combustion chamber through said cutout area.

2. A gas-fired water heater comprising:

a tank for storing water to be heated;

a combustion chamber disposed beneath said tank and having a top wall defining a bottom end of said tank, and a bottom wall spaced downwardly apart from said top wall and being at least partially defined by a flame arrestor plate having a plate-like body in which a mutually spaced series of flame quenching combustion air inlet openings are disposed;

a flue communicating with the interior of said combustion chamber and extending upwardly from said top wall through the interior of said tank;

a gas burner disposed in said combustion chamber;

a gas supply pipe extending into said combustion chamber and operatively connected to said gas burner;

a shield member disposed within said combustion chamber, overlying said combustion air inlet openings in an upwardly spaced relationship therewith, and positioned to intercept particulate matter falling from said top wall, and/or said flue, and prevent the fallen particulate matter from landing in and clogging said combustion air inlet openings, said shield member extending across substantially the entire top side of said body and having a cutout area receiving portions of said gas burner and said gas supply pipe, and said shield member defining a combustion air receiving plenum, disposed above said body within said combustion chamber, which is operative to receive combustion air upwardly exiting said combustion air inlet openings, said combustion air receiving plenum communicating with the balance of said combustion chamber through said cutout area.

3. Fuel-fired heating apparatus comprising:

a combustion chamber communicatable with a fluid to be heated and having vertically spaced apart, facing top and bottom wall structures, a portion of said bottom wall structure having combustion air inlet openings therein;

a fuel burner disposed within said combustion chamber;

a shield member disposed within said combustion chamber, overlying said combustion air inlet openings in an upwardly spaced relationship therewith, and positioned to intercept particulate matter falling from said top wall structure and prevent the fallen particulate matter from landing in and clogging said combustion air inlet openings, said bottom wall structure being a flame arrestor plate having a body portion, said mutually spaced series of combustion air inlet openings being distributed over substantially all of said body portion and being configured and operative as flame quenching openings; and a fuel supply pipe extending through said combustion chamber and operatively coupled to said fuel burner, said shield member extending across substantially the entire top side of said flame arrestor plate and having a cutout area receiving portions of said fuel burner and said fuel supply pipe, and said shield member defining a combustion air receiving plenum, disposed above said flame arrestor plate within said combustion chamber, which is operative to receive combustion air upwardly exiting said combustion air inlet openings, said combustion air receiving plenum communicating with the balance of said combustion chamber through said cutout area.

4. The fuel-fired heating apparatus of claim 3 wherein:

said fuel-fired heating apparatus is a fuel-fired water heater.

5. The fuel-fired heating apparatus of claim 4 wherein:

said fuel-fired water heater is a gas-fired water heater.

6. A gas-fired water heater comprising:

a tank for storing water to be heated;

a combustion chamber disposed beneath said tank and having a top wall defining a bottom end of said tank, and a bottom wall spaced downwardly apart from said top wall and being at least partially defined by a flame arrestor plate having a plate-like body in which a mutually spaced series of flame quenching combustion air inlet openings are disposed, said combustion air inlet openings being distributed over substantially all of said body;

a flue communicating with the interior of said combustion chamber and extending upwardly from said top wall through the interior of said tank;

a gas burner disposed in said combustion chamber;

a gas supply pipe extending into said combustion chamber and operatively connected to said gas burner;

a shield member disposed within said combustion chamber, overlying said combustion air inlet openings in an upwardly spaced relationship therewith, and positioned to intercept particulate matter falling from said top wall, and/or said flue, and prevent the fallen particulate matter from landing in and clogging said combustion air inlet openings, said shield member extending across substantially the entire top side of said body and having a cutout area receiving portions of said gas burner and said gas supply pipe, and said shield member defining a combustion air receiving plenum, disposed above said body within said combustion chamber, which is operative to receive combustion air upwardly exiting said combustion air inlet openings, said combustion air receiving plenum communicating with the balance of said combustion chamber through said cutout area.

7. The gas-fired water heater of claim 6 wherein:

said shield member has an upwardly domed configuration.

8. For use in operative association with the combustion chamber of a fuel-fired heating appliance, a flame arrestor plate assembly comprising:

a flame arrestor plate having a plate-like body with top and bottom sides and a peripheral portion, and a mutually spaced series of flame quenching combustion air inlet openings extending through said body between said top and bottom sides; and a shield member carried by said body and extending along at least a portion of said top side and over said combustion air inlet openings in an upwardly spaced relationship therewith, said shield member defining a combustion air-receiving plenum overlying said combustion air inlet openings and having a combustion air discharge opening, said shield member further having a peripheral portion secured to said peripheral portion of said body of said flame arrestor plate in a substantially contiguous relationship therewith.

9. The flame arrestor plate assembly of claim 8 wherein:

said mutually spaced series of combustion air inlet openings are distributed over substantially all of said body, and said shield member extends across substantially the entire top side of said body and has a top side cutout area that forms said combustion air discharge opening.

10. The flame arrestor plate assembly of claim 8 wherein:

said mutually spaced series of combustion air inlet openings are distributed over only a part of said body, and said shield member extends across the top side of only said part of said body.

11. The flame arrestor plate assembly of claim 10 wherein:

said combustion air discharge opening faces in a direction generally parallel to said top side of said body.

12. The flame arrestor plate assembly of claim 8 wherein:

said shield member has an upwardly domed configuration.

13. Fuel-fired heating apparatus comprising:

a combustion chamber communicatable with a fluid to be heated and having vertically spaced apart, facing top and bottom wall structures, a portion of said bottom wall structure having combustion air inlet openings therein;

a fuel burner disposed within said combustion chamber; and a shield member disposed within said combustion chamber, overlying said combustion air inlet openings in an upwardly spaced relationship therewith, and positioned to intercept particulate matter falling from said top wall structure and prevent the fallen particulate matter from landing in and clogging said combustion air inlet openings, said bottom wall structure being a flame arrestor plate having a body portion, and said mutually spaced series of air inlet opening being disposed in only part of said body portion and being configured and operative as flame quenching openings, said shield member extending across the top side of only said part of said body portion and defining a combustion air receiving plenum, disposed within said combustion chamber above said part of said body portion, which is operative to receive combustion air upwardly exiting said combustion air inlet openings, said combustion air receiving plenum having an outlet portion through which it communicates with the balance of said combustion chamber, said shield member further having a peripheral portion secured to a peripheral portion of said body portion of said flame arrestor plate in a substantially contiguous relationship therewith.

14. A gas-fire water heater comprising:

a tank for storing water to be heated;

a combustion chamber disposed beneath said tank and having a top wall defining a bottom end of said tank, and a bottom wall spaced downwardly apart from said top wall and being at least partially defined by a flame arrestor plate having a plate-like body in which a mutually spaced series of flame quenching combustion air inlet openings are disposed, said mutually spaced series of combustion air inlet openings being disposed in only part of said body;

a flue communicating with the interior of said combustion chamber and extending upwardly from said top wall through the interior of said tank;

a gas burner disposed in said combustion chamber;

a gas supply pipe extending into said combustion chamber and operatively connected to said gas burner; and a shield member disposed within said combustion chamber, overlying said combustion air inlet openings in an upwardly spaced relationship therewith, and positioned to intercept particulate matter falling from said top wall, and/or said flue, and prevent the fallen particulate matter from landing in and clogging said combustion air inlet openings, said shield member extending across the top side of only said part of said body and defining a combustion air receiving plenum, disposed within said combustion chamber above said part of said body, which is operative to receive combustion air upwardly exiting said combustion air inlet openings, said combustion air receiving plenum having an outlet portion through which it communicates with the balance of said combustion chamber, said shield member further having a peripheral portion secured to a peripheral portion of said flame arrestor plate body in a substantially contiguous relationship therewith.

15. The gas-fired water heater of claim 14 wherein:

said outlet portion includes a combustion air discharge opening facing in a direction generally parallel to the top side of said body.

* * * * *